US005910089A

United States Patent [19]

Weder

[11] Patent Number: 5,910,089

[45] Date of Patent: Jun. 8, 1999

[54] PACKAGING MATERIAL

[75] Inventor: Donald E. Weder, Highland, Ill.

[73] Assignee: Southpac Trust International, Inc.

[21] Appl. No.: 08/899,249

[22] Filed: Jul. 23, 1997

[51] Int. Cl.[6] ..... B65B 55/20

[52] U.S. Cl. ..... 53/472; 53/121; 53/474; 493/464; 493/967

[58] Field of Search ..... 53/472, 474, 121, 53/461, 390; 493/464, 967; 206/584, 521, 521.2

[56] References Cited

U.S. PATENT DOCUMENTS

| | | | |
|---|---|---|---|
| 2,786,399 | 3/1957 | Mason et al. | 93/1 |
| 2,924,154 | 2/1960 | Russell et al. | 93/1 |
| 3,509,797 | 5/1970 | Johnson | 53/472 X |
| 3,905,057 | 9/1975 | Willis et al. | 5/337 |
| 4,026,198 | 5/1977 | Ottaviano | 93/1 |
| 4,247,289 | 1/1981 | McCabe | 493/386 |
| 4,937,131 | 6/1990 | Baldacci et al. | 428/131 |
| 5,088,972 | 2/1992 | Parker | 493/352 |
| 5,173,352 | 12/1992 | Parker | 428/174 |
| 5,257,492 | 11/1993 | Watts | 53/472 X |
| 5,312,665 | 5/1994 | Pratt et al. | 493/967 X |
| 5,568,867 | 10/1996 | Lencoski | 206/584 |
| 5,615,534 | 4/1997 | Weder | 53/461 X |
| 5,643,647 | 7/1997 | Wischusen, III | 493/967 X |
| 5,661,955 | 9/1997 | Maida et al. | 53/472 X |

*Primary Examiner*—James F. Coan
*Attorney, Agent, or Firm*—Dunlap, Codding & Rogers, P.C.

[57] ABSTRACT

A packaging material comprising a plurality of cushioning members for cushioning an article in a container is provided. The cushioning members being formed by crumpling a flexible sheet of material into a globular configuration having a plurality of random folds, a plurality of random engaged portions, and a plurality of voids. The sheet of material has an upper surface and a lower surface with at least one of the upper surface and the lower surface having a bonding material disposed thereon such that at least a portion of the engaged portions are bondably connected thereby increasing the resiliency of the folds.

3 Claims, 2 Drawing Sheets

PACKAGING MATERIAL

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention.

The present invention relates generally to cushioning materials for packaging articles, and more particularly, but not by way of limitation, to a packaging material comprising a plurality of cushioning members wherein each of the cushioning members is formed of a crumpled sheet of flexible material having a bonding material disposed thereon for bondably connecting overlapping portions of the crumpled sheet of material to enhance the resiliency of the crumpled sheet of material.

2. Brief Description of the Related Art.

In the process of shipping an article from one location to another, the article is typically placed in a container along with a protective packaging material to fill the voids about the article and to cushion the article during the shipping process. One common protective packaging material is comprised of a plurality of plastic foam, peanut-shaped members, which are commonly known as "styrofoam peanuts." An advantage of using styrofoam peanuts is the ease with which they may be disposed about an article positioned in a container by simply pouring the styrofoam peanuts from a dispenser.

Styrofoam peanuts have been widely accepted in the packaging industry, however, they are not without disadvantages. For example, the light weight and flowability of the styrofoam peanuts results in heavier objects gravitating through the peanuts to the bottom of the container where the object can be damaged. Also, while the flowability of the styrofoam peanuts facilitates the introduction of the peanuts into a container, the receiver of the package is left with having to deal with the peanuts upon removal of the article from the container in the form of having to clean up the mess left by the peanuts which are easily scattered upon removal of the article from the container.

These disadvantages, as well as the environmental problems associated with the disposal of styrofoam peanuts, has made paper protective packaging material a popular alternative. Paper is biodegradable, recyclable and renewable, making it an environmentally responsible choice. However, like styrofoam peanuts, paper packaging materials, such as crumpled sheets of newsprint, are not without disadvantages in that they are generally not very resilient, and thus, large amounts of paper are required to provide the bulk needed to adequately cushion an article.

An example of a paper cushioning product is disclosed in U.S. Pat. No. 5,568,867, issued to Lencoski. More specifically, Lencoski '867 teaches a thimble shaped cushioning product formed from a sheet of paper. The cushioning product is formed by inserting a punch through a die with a sheet of paper positioned therebetween so as to form the sheet of paper into the thimble shaped cushioning product. The cushioning product includes a closed lower end, an open upper end, and a tubular sidewall having a plurality of overlapping folds formed therein. Again, the problem encountered in the use of the paper cushioning product of Lencoski is that the flexibility of the paper results in the cushioning product not being able to retain its shape when subjected to compressive stresses. Thus, the cushioning products are easily crushed and deformed whereby voids can develop about the packed article during the shipping process and the resiliency or cushioning effect provided by the cushioning products can quickly deteriorate.

U.S. Pat. Nos. 3,655,500, 4,109,040, and 4,717,613, disclose cushioning dunnage products formed of a flexible, multi-ply stock material wherein the edges of the stock material are rolled inwardly to form pillow-like portions which are connected together along their engaged abutting sides by coining or adhesive. While such dunnage products have achieved varying degrees of success, the manufacture of such products requires the use of specific equipment which dictates that such products be manufactured and then shipped to the end user rather than formed by the end user. This in turn leads to increased costs in the form of manufacturing and the storage and shipping of a voluminous product.

To this end, an improved packaging material is needed which can be manually or mechanically formed from a sheet of flexible material into a resilient cushioning member and which can be formed just prior to use. It is to such a packaging material that the present invention is directed.

BRIEF SUMMARY OF THE INVENTION

The present invention is directed to a cushioning member for use as a packaging material. The cushioning member is formed of a flexible sheet of material crumpled into a globular configuration such that the sheet of material has a plurality of random folds, a plurality of random engaged portions, and a plurality of voids. The sheet of material has an upper surface and a lower surface with at least one of the upper surface and the lower surface having a bonding material disposed thereon such that at least a portion of the engaged portions of the sheet of material are bondably connected thereby increasing the resiliency of the folds.

The present invention also provides a method of forming a cushioning member for use in packaging an article which generally includes the steps of providing a sheet of material having a bonding material disposed on at least one side thereof, and crumpling the sheet of material into a globular configuration such that the sheet of material has a plurality of random folds, a plurality of random engaged portions, and a plurality of voids and such that at least a portion of the engaged portions are bondably connected.

In one embodiment, the sheet of material is provided in a pad of a plurality of sheets of material whereby the sheet of material is removed from the pad prior to crumpling the sheet of material.

A plurality of the cushioning members may be incorporated into a package which additionally includes a container and an article positioned within the container. The cushioning members may be positioned into the container to substantially surround the article positioned within the container. In this manner, the cushioning members will function as a protective packaging material which cushions the article during a shipping process.

The objects, features and advantages of the present invention will become apparent from the following detailed description when read in conjunction with the accompanying drawings and appended claims.

DETAILED DESCRIPTION OF THE INVENTION

Figure 1:
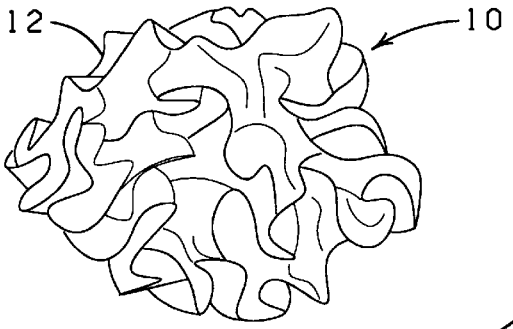
FIG. 1 is a perspective view of a cushioning member constructed in accordance with the present invention.
Figure 2:
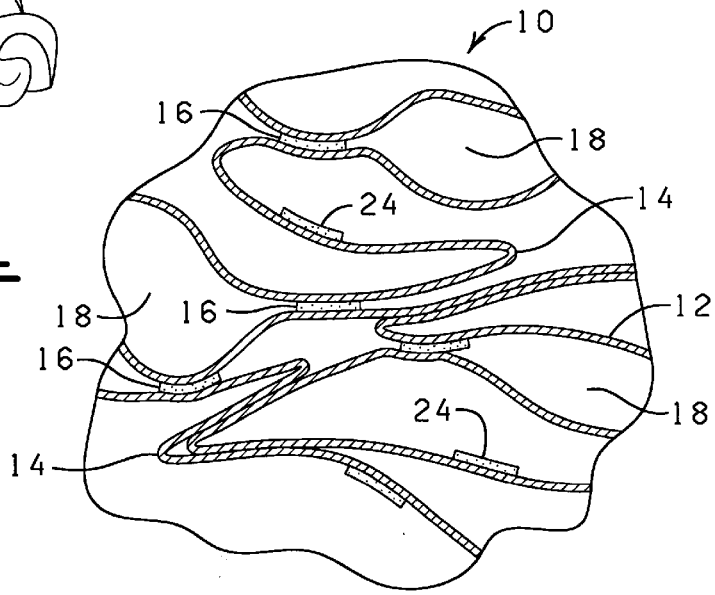
FIG. 2 is an enlarged sectional view of a portion of the cushioning member of FIG. 1.

Referring now to the drawings, and more particularly to FIGS. 1 and 2, a cushioning member 10 constructed in accordance with the present invention is illustrated. The cushioning member 10 is formed from a flexible sheet of material 12 crumpled into a cubical, rectangular, spherical, or otherwise globular configuration having a plurality of random folds 14, a plurality of random engaged portions 16, and a plurality of voids 18. The sheet of material 12 can be crumpled to form the cushioning member 10 manually or with a suitable apparatus, such as that disclosed in U.S. Pat. No. 2,924,154, issued to Russell et al. on Feb. 9, 1960, which is hereby expressly incorporated herein by reference.

Figure 3:
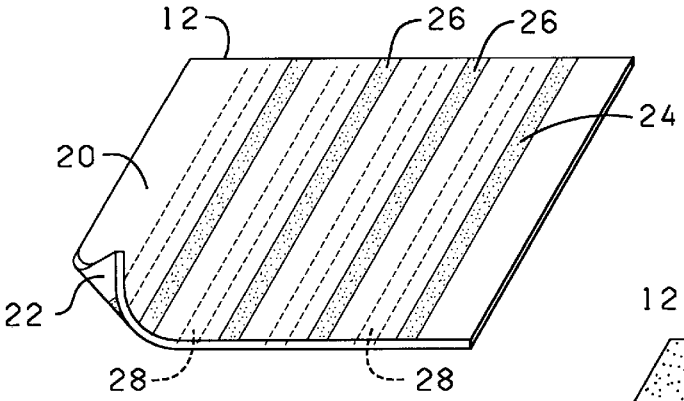
FIG. 3 is a perspective view of a sheet of material for use in forming the cushioning member of the present invention.

Referring now to FIG. 3, the sheet of material 12 is a substantially square or rectangle sheet of material having a length of approximately two to four feet and a width of approximately two to four feet. However, it will be appreciated that the dimensions of the sheet of material 12 may be varied. The sheet of material 12 can be any flexible sheet of material, including paper, crepe paper, polymeric film, laminated polymeric film, and waxed paper, for example. The sheet of material 12 may have printed matter and/or embossed pattern on at least one side thereof, and the embossed pattern can be either in register or out of register with the printed pattern. Different colors can be employed to provide the printed pattern on the sheet of material 12.

The sheet of material 12 can also be embossed so as to provide the sheet of material 12 with an embossed pattern. Further, the sheet of material 12 can be provided with an embossed pattern as well as a printed pattern, and the embossed pattern can be either in register or out of register with the printed material and/or printed design.

The sheet of material 12 may be constructed of a single layer of material or a plurality of layers of the same or different types of materials. In addition, any thickness of the sheet of material 12 may be utilized with the present invention so long as the sheet of material 12 is shapeable into the cushioning member 10.

Although the sheet of material 12 shown in FIG. 3 is square, the sheet of material 12 may be any shape. For example, the sheet of material 12 may be square, rectangular, circular or any other geometric shape. The shape of the sheet of material 12 may even have an irregular, capricious or decorative shape.

The cushioning effect provided by the cushioning member 10 results from the resiliency of the folds 14 and the volume provided by the voids 18. However, as mentioned above, crumpled sheets of material, particularly crumpled sheets of paper, are generally not very resilient, and thus, large amounts of material are required to provide the bulk needed to adequately cushion an article. In an effort to overcome these drawbacks, the present invention contemplates bondably connecting the engaged portions 16 of the sheet of material 12 thereby imparting an additional degree of stiffness to the cushioning member 10 so as to enhance the resiliency of the cushioning member 10, and at the same time, provide the opportunity to reduce the weight of packaging material through the use of thinner and fewer sheets of material.

To achieve these desired effects, the sheet of material 12 is coated with a bonding material such as an adhesive or cohesive whereby at least a portion of the engaged portions 16 of the sheet of material 12 are caused to bond together when the sheet of material 12 is crumpled into the cushioning member 10 illustrated in FIG. 1. More specifically, the sheet of material 12, illustrated in FIG. 3, has an upper surface 20, a lower surface 22, and a bonding material 24 disposed on the upper surface 20 and the lower surface 22. In FIG. 3, the sheet of material 12 is illustrated as being strip coated with the bonding material 24 on the upper surface 20 and the lower surface 22 wherein the bonding material 24 is disposed in the form of a plurality of parallel, spaced apart strips 26 on the upper surface 20 and a plurality of parallel, spaced apart strips 28 on the lower surface 22. The strips 28 of bonding material 24 on the lower surface 22 of the sheet of material 12 are preferably in a staggered relationship relative to the strips 26 of bonding material 24 on the upper surface 20 of the sheet of material 12. However, it will be appreciated that the strips 28 of bonding material 24 on the lower surface 22 of the sheet of material 12 can be aligned with the strips 26 of bonding material 24 on the upper surface 20, formed in a diagonal or perpendicular relationship, or strips of bonding material 24 may be disposed on only one of the upper surface 20 or the lower surface 22.

Figure 4:
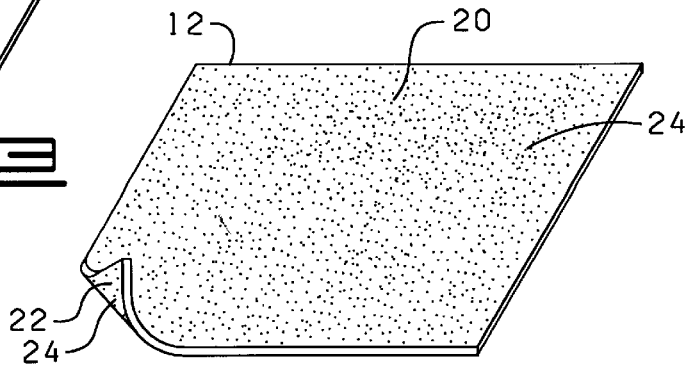
FIG. 4 is a perspective view of another sheet of material for use in forming the cushioning member of the present invention.

Alternatively, as illustrated in FIG. 4, the bonding material 24 may be applied in such a manner as to substantially coat both of the upper surface 20 and the lower surface 22 of the sheet of material 12. It will be further appreciated that the bonding material 24 may be disposed on only one of the upper surface 20 or the lower surface 22 or disposed in any of a variety of other patterns such as circles, dots or any other geometric or biomorphic shape, including decorative designs, so long as the bonding material 24 is positioned to function in accordance with the present invention.

The term "bonding material" as used herein can mean an adhesive, frequently a pressure sensitive adhesive, or a cohesive or any adhesive/cohesive combination, having adhesive qualities (i.e., qualities of adhesion or adhesion/cohesion, respectively) sufficient to effect the connection between portions of the sheet of material 12 brought into engagement with one another. It will be appreciated that both adhesives and cohesives suitable for the purposes described herein are well known in the art, and both are commercially available.

Referring again to FIG. 2, the engaged portions 16 of the cushioning member 10 are formed by overlapping portions of the sheet of material 12 and bringing such overlapping portions into engagement or contact with one another during the crumpling process. In this manner, the engaged portions 16 that are coated with the bonding material 24 are fixed to one another.

By bondably connecting portions of the cushioning member 10, the degree of resiliency of the cushioning member 10 can be controlled. That is, depending on the surface of the sheet of material 12 the bonding material 24 is applied to, the pattern in which the bonding material 24 is applied, and the tackiness of the bonding material 24 used, the cushioning member 10 will be formed with a variety of degrees of voids and rigidity. For example, if the bonding material 24 is applied to the upper surface 20 of the sheet of material 12 so as to coat the entire upper surface 20, as shown in FIG. 4, and the sheet of material 12 is formed into the cushioning member 10 so that the upper surface 20 of the sheet of material 12 is predominately within the interior of the cushioning member 10, opposing portions of the cushioning member 10 defining the voids 18 may have a tendency to bond when a compressive force is applied to the cushioning member 10, thereby reducing the resiliency of the cushioning member 10. The use of bonding materials with a lesser degree of tack can alleviate the bonding of the portions defining the voids 18, as well as the application of the bonding material to less than the entire upper surface 20 of the sheet of material 12, such as in the form of strips, spots, and the like. Also, the use of a stiffer bonding material can increase the rigidity of the sheet of material 12 and thus increase the resiliency of the cushioning member 10.

If the bonding material 24 is applied to the lower surface 22 of the sheet of material 12 so as to coat the entire lower surface 22, and the sheet of material 12 is formed into the cushioning member 10 so that the lower surface 22 of the sheet of material 12 predominately forms the exterior surface of the cushioning member 10, adjacent cushioning members 10 may have a tendency to bond or stick together. Again, the use of bonding materials with a lesser degree of tack, as well as the application of the bonding material to less than the entire lower surface 22 of the sheet of material 12, such as in the form of strips, spots, and the like, can alleviate this condition if it is undesirable. In some instances, however, it may be desirable for the cushioning members 10 to adhere to one another to form a cohesive cushioning unit. The formation of such a cohesive unit can reduce the mess associated with scattering of loose or flowable packing material and prevent an article surrounded by the cohesive unit from gravitating through the cushioning members 10, as can be experienced with the use of loose packing materials.

Figure 5:
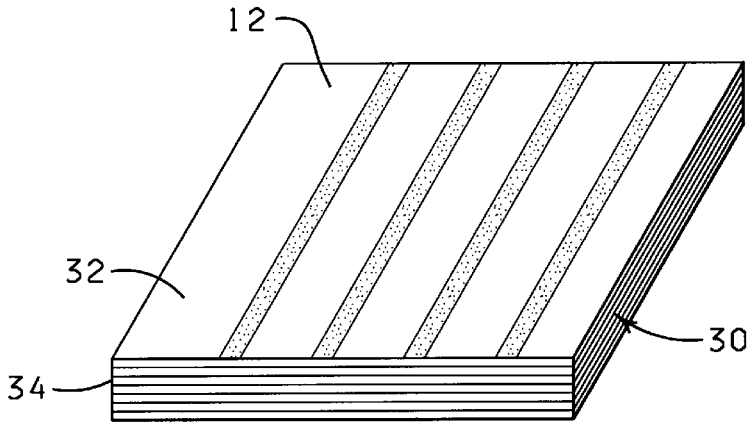
FIG. 5 is a perspective view of a pad of a plurality of the sheets of material of FIG. 3.

As illustrated in FIG. 5, the present invention further contemplates a plurality of sheets of material 12 connected together to form a pad 30 of sheets of material 12. The pad 30 comprises a plurality of sheets of material 12 stacked one on top of the other and positioned so that the periphery of the sheets of material 12 in the pad 30 are generally aligned. The pad 30 is characterized has having a top sheet of material 32 and a next sheet of material 34 disposed thereunder, the other sheets of material being disposed under the next sheet of material 34 in the pad 30 of sheets of material 12.

The top sheet of material 32 is capable of being disconnected from the pad 30 of sheets of material 12. When the top sheet of material 32 is disconnected from the pad 30, the next sheet of material 34 forms the new top sheet of material, and the sheet of material lying under the new top sheet of material forms a new next sheet of material.

In a general method of use, the top sheet of material 32 is removed or disconnected from the pad 30 of sheets of material 12. The removed sheet of material is then crumpled into a cushioning member 12, as described above, such that the cushioning member 12 has a plurality of random folds, a plurality of random engaged portions, and a plurality of voids and such that at least a portion of the engaged portions are bondably connected.

Figure 6:
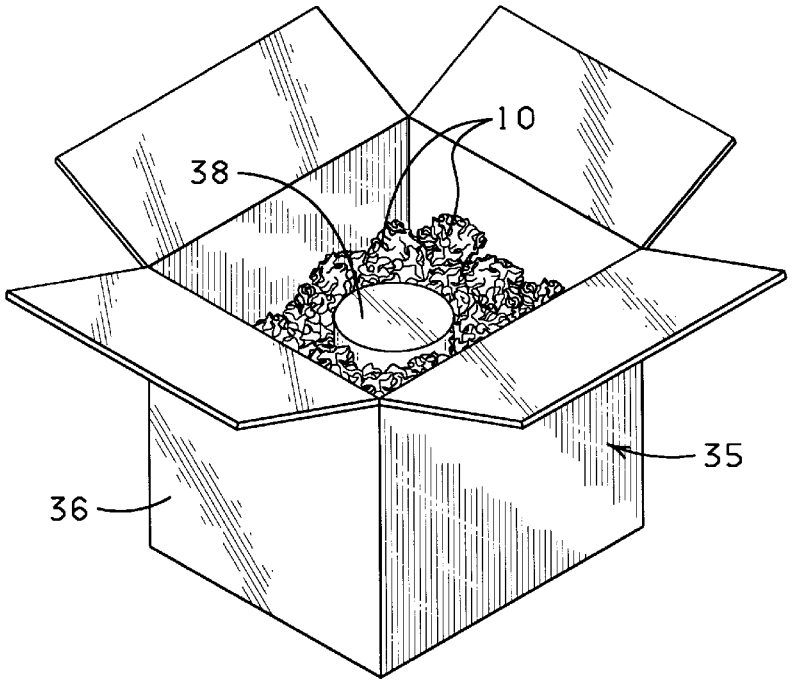
FIG. 6 is a perspective view of a package incorporating a plurality of cushioning members constructed in accordance with the present invention.

Referring now to FIG. 6, a plurality of the cushioning members 10 are shown incorporated into a package 35. The package 35 includes a container 36 and an article 38 positioned within the container 36. The cushioning members 10 may be positioned in the container 36 so as to substantially surround the article 38 positioned within the container 36. In this manner, the cushioning members 10 will function as a protective packaging material filling voids about the article 38 and supporting and cushioning the article 38 during a shipping process.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A method of packaging an article, comprising the steps of:

(a) positioning the article in a container;

(b) providing a sheet of material having a bonding material disposed on at least one surface thereof;

(c) crumpling the sheet of material into a substantially globular configuration such that the sheet of material has a plurality of random folds, a plurality of random engaged portions, and a plurality of voids and such that at least a portion of the engaged portions are bondably connected thereby increasing the resiliency of the folds;

(d) disposing the crumpled sheet of material into the container about the article; and (e) repeat steps (b)–(d) until the article is substantially surrounded by the crumpled sheets of material to provide a protective cushion about the article.

2. A method of packaging an article, comprising the steps of:

(a) positioning the article in a container;

(b) removing a sheet of material from a pad of a plurality of sheets of material, each sheet of material of the pad of sheets of material having a bonding material disposed on at least one surface thereof;

(c) crumpling the removed sheet of material into a substantially globular configuration such that the removed sheet of material has a plurality of random folds, a plurality of random engaged portions, and a plurality of voids and such that at least a portion of the engaged portions are bondably connected thereby increasing the resiliency of the folds;

(d) disposing the crumpled sheet of material into the container about the article; and (e) repeat steps (b)–(d) until the article is substantially surrounded by the crumpled sheets of material to provide a protective cushion about the article.

3. A method of packaging an article, comprising the steps of:

(a) positioning the article in a container;

(b) providing a sheet of material having a bonding material disposed on at least one surface thereof;

(c) crumpling the sheet of material such that the sheet of material has a plurality of random folds, a plurality of random engaged portions, and a plurality of voids and such that at least a portion of the engaged portions are bondably connected thereby increasing the resiliency of the folds;

(d) disposing the crumpled sheet of material into the container about the article; and (e) repeat steps (b)–(d) until the article is substantially surrounded by the crumpled sheets of material to provide a protective cushion about the article.

* * * * *

UNITED STATES PATENT AND TRADEMARK OFFICE

CERTIFICATE OF CORRECTION

PATENT NO. : 5,910,089
DATED : June 8, 1999
INVENTOR(S) : Donald E. Weder

It is certified that error appears in the above-identified patent and that said Letters Patent is hereby corrected as shown below:

Column 2,
Line 46, delete "are" and substitute therefor -- is --.

Column 5,
Line 9, after "material" and before "to" insert -- 24 --.
Line 22, after "material" and before "to" insert -- 24 --.
Line 52, delete "12," and substitute therefore -- 10, --.
Line 53, delete "12," and substitute therefor -- 10, --.
Line 53, delete "folds," and substitute therefor -- folds 14, --.
Line 54, delete "portions," and substitute therefor -- portions 16, --.
Line 55, after "voids" and before "and" insert -- 18 --.
Line 55, after "engaged portions" insert -- 16 --.
Line 56, delete "are" and substitute therefor -- is --.

Column 6, claim 1,
Line 19, delete "are" and substitute "are" and substitute therefor -- is --.
Line 23, delete "repeat" and substitute therefor -- repeating --.

Column 6, claim 2,
Line 38, delete "are" and substitute therefor -- is --.
Line 42, delete "repeat" and substitute therefor -- repeating --.

Column 6, claim 3,
Line 53, delete "are" and substitute therefor -- is --.
Line 58, delete "repeat" and substitute therefor -- repeating --.

Signed and Sealed this

Eleventh Day of December, 2001

*Attest:*

Nicholas P. Godici

NICHOLAS P. GODICI
*Acting Director of the United States Patent and Trademark Office*

*Attesting Officer*